United States Patent [19]

Hoselton

[11] 4,165,020

[45] Aug. 21, 1979

[54] CLOSURES AND CONTAINER ASSEMBLIES

[75] Inventor: Harry Hoselton, Wheeling, W. Va.

[73] Assignee: Polysar Resins, Inc., Leominister, Mass.

[21] Appl. No.: 925,167

[22] Filed: Jul. 17, 1978

[51] Int. Cl.[2] ..... B65D 41/16

[52] U.S. Cl. ..... 220/306; 220/380; 206/505; 206/508; 150/0.5

[58] Field of Search ..... 220/306, 307, 380; 206/503, 505, 508; 150/0.5; 215/320, 321, 317

[56] References Cited

U.S. PATENT DOCUMENTS

| | | | |
|---|---|---|---|
| 3,378,177 | 4/1968 | Gran | 220/306 X |
| 4,079,857 | 3/1978 | Crisci | 220/306 |

*Primary Examiner*—George T. Hall

*Attorney, Agent, or Firm*—Stevens, Davis, Miller & Mosher

[57] ABSTRACT

A plastic closure with a U-shaped rim surrounding a closure portion, an upper wall of the rim extending both upwardly and downwardly from the closure portion and flaring outwardly away from the closure portion. The upper end of the inner wall joins into the base of the 'U' shape and the lower end is resiliently flexible. When fitted to a container, upper and lower ends of the inner wall seal against the lip and inner surface of the wall of the container, resiliency of the inner wall of the closure ensuring its sealing engagement with the container wall.

6 Claims, 3 Drawing Figures

CLOSURES AND CONTAINER ASSEMBLIES

This invention relates to closures and closure and container assemblies.

In the use of containers and closures made from metal, problems of corrosion are encountered. Another problem which is found is that of sealing closures upon containers in such a way that leakage problems do not result and closures are removable without damage either by cutting or by distortion.

One way of overcoming the corrosion problem associated with metal closures is to replace metal with a plastic material. Because the strength properties of plastics materials are different from metals, the change to a plastics material has led to new departures in design and methods of fitting of plastic closures to containers. Problems are found in providing efficient seals when using plastics closures.

According to one aspect of the present invention, a plastic closure is provided having an inverted U-shaped annular rim surrounding a closure portion, the rim defining a downwardly facing recess and having an inner axially extending wall which has a portion extending upwardly from the closure portion to a base of the 'U' and a resiliently flexible portion extending downwardly to terminate in a free end. These two portions have outer surfaces which increase in diameter as they extend from the closure portion so that when a container annular wall is received within the recess, the upper portion and the free end of the lower portion sealingly engage the container lip and the inner surface of the annular wall in spaced-apart positions with the lower portion being resiliently flexed radially inwards by its engagement with the annular wall. The outer wall of the closure has a locking means facing into the recess to engage the outer wall of the container to hold the closure upon the container when the closure is fitted thereto.

The invention also includes a container and closure assembly having a closure according to the invention as defined above and fitted to the container.

With the above construction according to the invention, two sealing locations are provided between the inner wall of the U-shaped rim and the container. Because the closure portion is provided intermediate the upper and lower ends of the inner wall so as to provide upper and lower wall portions, these portions flex mainly about their position of junction with the closure portion. Hence, the flexing of one of the wall portions results in no flexing or an insignificant amount of flexing of the other portion. Thus, the resiliently flexible lower portion may be flexed resiliently to conform to the inside shape of the annular wall and seal against it while a seal is simultaneously provided between the upper portion and the lip of the container without distortion of one wall portion affecting the sealing action of the other.

In a preferred construction, the annular wall of the container is tapered downwardly and in a normal position of the closure upon the container, the base of the closure is spaced from the lip of the container and the placing of a downward force upon the closure urges the U-shaped rim downwards to cause the base to move towards the lip and increase the sealing pressure of the upper portion of the inner wall upon the lip and increase the sealing pressure of the lower portion of the inner wall upon the tapered annular wall as it moves down the annular wall.

One embodiment of the invention will now be described by way of example with reference to the accompanying drawings in which.

Figure 1:
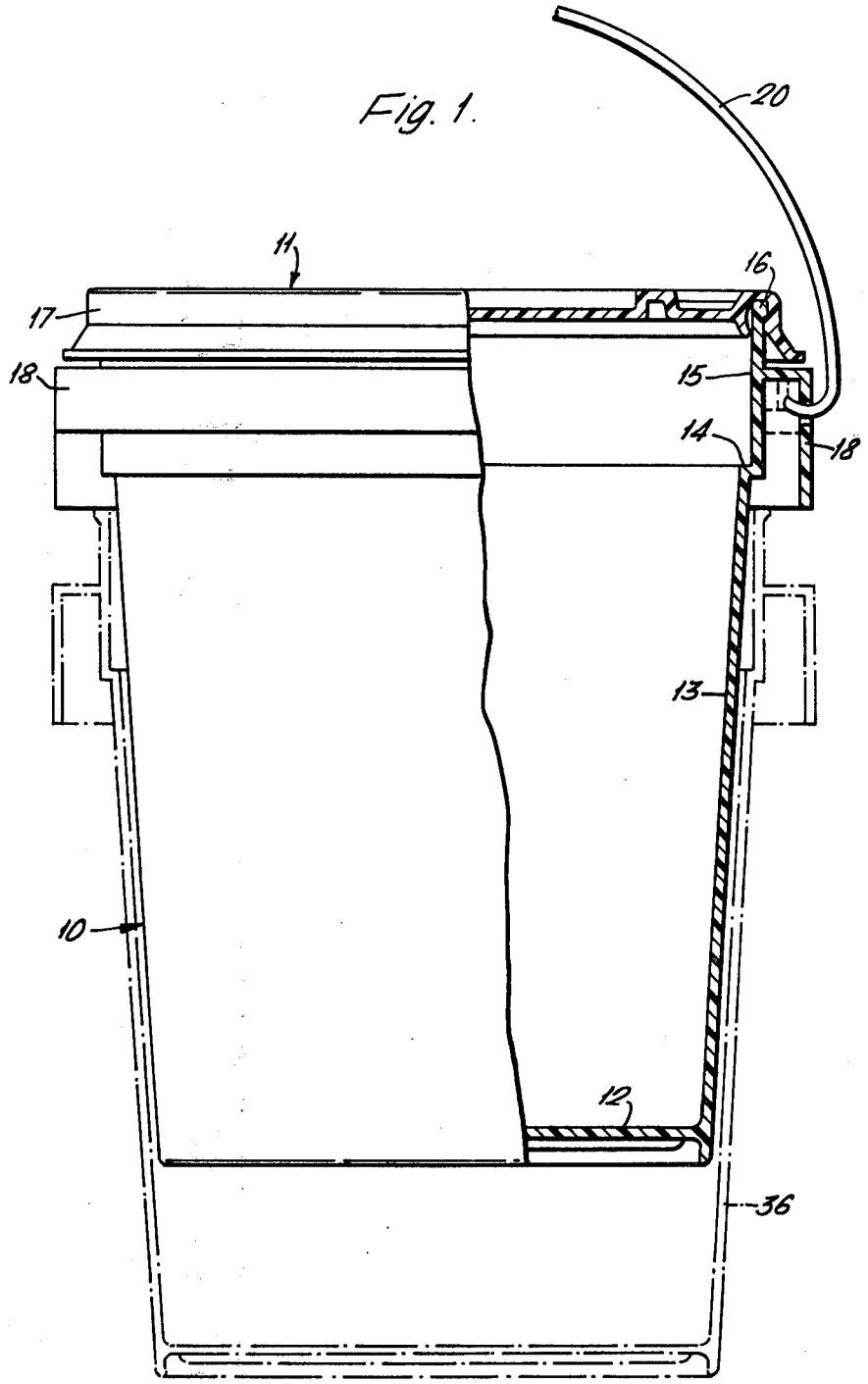
FIG. 1 is a side-elevational view, partly in cross-section of a container and closure assembly according to the invention.

In the embodiment, a container and closure assembly comprises a container 10 and closure 11, both injection moulded from high density polyethylene although other suitable mouldable plastics materials, e.g. polypropylene, may be used instead.

The container comprises a base 12 extending upwardly from which is an annular wall 13 which is of frusto-conical shape up to an outwardly jutting shoulder 14. Above shoulder 14, the annular wall continues as an upper portion 15 which tapers from a lip 16 down to the shoulder at an angle of approximately 2° to the vertical axis of symmetry of the assembly. The upper wall portion 15 is surrounded by a stiffening skirted buttress 17 extending outwardly therefrom and this buttress extends downwardly to provide diametrically opposed deep sections 18 provided with holes 19 into which are inserted the ends of a bail member 20 for lifting the container.

As may be seen from FIG. 1, the tapered annular wall 13 enables unfilled and identical containers to be stacked. An identical container 10 in chain-dotted outline carriers the container 10, in full outline, telescoped within it. Engagement of the lip 16 of the lower container with the underside of the deep sections 18 of the buttress 17 of the upper container, prevents jamming together of the containers, for instance by interengagement of the annular walls 13.

Figure 2:
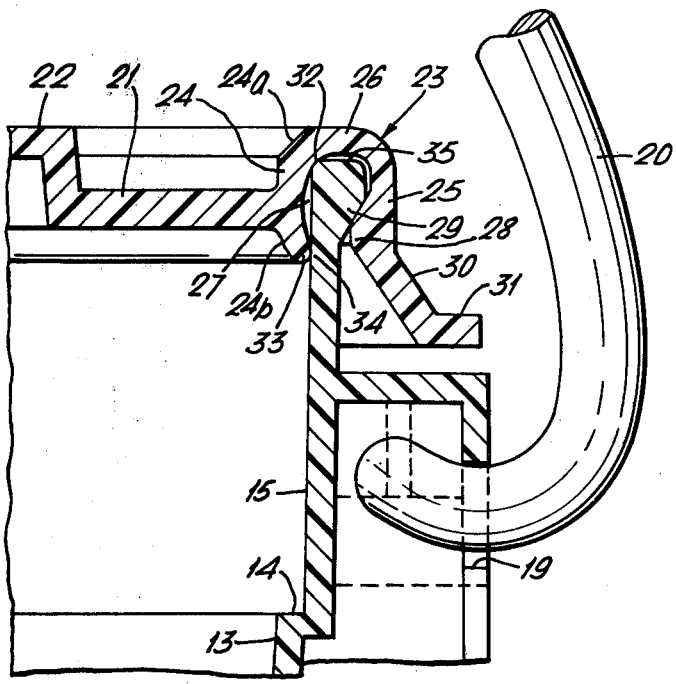
FIG. 2 is a cross-sectional view of part of the assembly of FIG. 1 and on a larger scale.

FIG. 2 shows in detail the construction of the closure 11 and its manner of fitting to the container. The closure is injection moulded from high density polyethylene although other suitable mouldable plastics materials e.g. polypropylene, may be used instead.

The closure 11 comprises a substantially planar closure portion 21 having an annular reinforcing rib 22 of "top-hat" cross-section lying towards its outer edges. Surrounding the closure portion is an annular rim 23. This rim is of inverted U-shape and comprises a radially inner axially extending wall 24 and a radially outer axially extending wall 25, the walls being spaced by a base 26 and defining between them, a downwardly facing recess 27 within which is located the lip 16 of the container. A locking means is provided to hold the closure onto the container, this locking means comprising a locking rib 28, moulded integrally with the outer wall 25 and extending into the recess 27, and a downward facing shoulder 29 of the container. As shown, the container is fitted onto the container in snap-on fashion. To allow for this, the outer wall 25 is resiliently flexible outwards to widen the recess and enable the locking rib 28 to be passed over the lip 16 progressively around the lip until the whole of the rib 28 is located beneath the shoulder 29 in which position it is retained by the resilient nature of the wall 25. A free end 30 of the outer wall is flared outwards and terminates in a foot 31 which is spaced slightly above the buttress 17. The shape of the end 30 and its spacing above the buttress 17 assists in removal of the closure when a removal tool is inserted into the space and is levered in the appropriate direction.

The inner wall 24 comprises a portion 24*a* extending upwardly from the closure portion 21 to the base and a portion 24*b* extending downwardly from the closure portion. Each portion 24*a* and 24*b* has a radially outer surface which increases in diameter as it extends away from the closure portion. The outer surface of the upper portion increases in diameter so that in a normal closed position of the closure upon the container, the outer surface sealingly engages the inside edge of lip 16 at a position 32 adjacent to the junction region of the wall 24 with the base 26. At this position, sealing contact is along a single annular line around the lip and because of the relative shapes of the engaging surfaces there is substantially a point contact when considered in a cross-section along the axis of the assembly. As the position 32 is adjacent the junction region of the wall 24 with the base 26, it lies in an area of greater stiffness than elsewhere.

As compared to the upper wall portion 24*a*, lower wall portion 24*b* is resiliently flexible. It terminates in a free end 33 which is splayed outwardly from the closure portion 21 as the outside diameter increases. The free end 33 has a position 34 of contact with the inner surface of the upper wall portion 15. Sealing contact is along a single annular line at position 34 and because of the relative shapes of the engaging surfaces there is substantially a point contact when considered in a cross-section along the axis of the assembly.

In the normal fitted condition of closure to container, the locking rib 28 engages beneath the locking shoulder 29 to hold the lip 16 within the recess and with the inside edge of the lip pressed, by the locking means, into sealing engagement with the inner wall 24 adjacent the base 26. In this normal fitted condition, there is a space 35 between the lip 16 and the base 26 of the rim. Because of its stiffness, the junction of inner wall and base provides a resistance to the pressure applied to it by the lip thus causing the lip to flex sufficiently to accommodate itself to the annular contour of the inner wall at the position 32. An efficient seal is, therefore, obtained at this position along the substantial point contact as viewed in cross-section along the axis of the assembly.

The free end 33 of lower wall portion 24*b* has a diameter which is normally slightly larger than that of the inner surface of the wall portion 15 at the point of contact 34. Thus, in the normal fitted condition of closure to container, the lower wall portion 24*b* is resiliently flexed inwards by the wall portion 15 so as to seal against the wall portion 15 at position 34.

Hence, in the assembled state, there are two annular lines of sealing contact between the container and closure, at positions 32 and 34 which are axially spaced apart. At position 32, the stiffness offered by the closure and the resiliency of the lip 16 provide the seal under the pressure applied between the components by the action of the locking means. On the other hand, at position 34, it is the resiliency of the lower wall portion 24*b* which is instrumental in forming the seal against the container wall portion 15.

Figure 3:
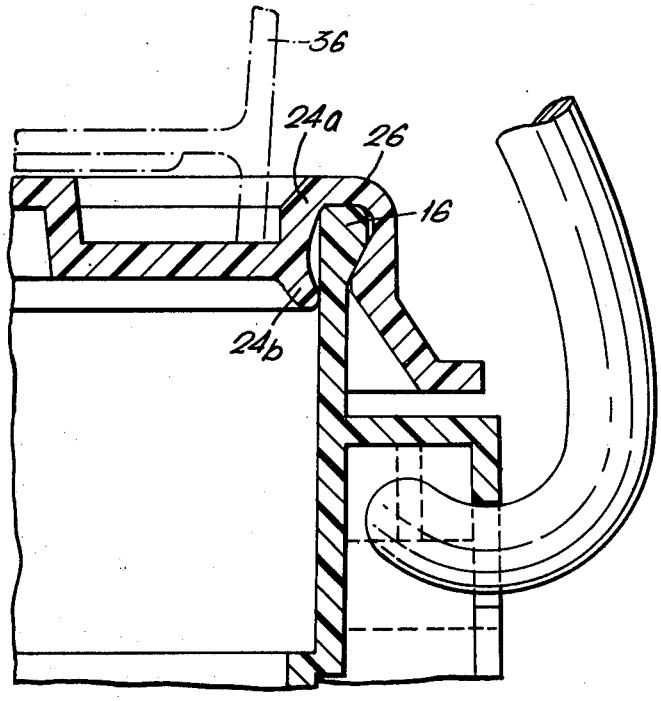
FIG. 3 is a view similar to FIG. 2 showing the assembly as part of a stack of filled containers.

With the two wall portions 24*a* and 24*b* extending in their respective directions from the closure portion 21, any flexing of one or the other of the wall portions is dissipated to a great extent at the junction of that wall portion with the closure portion and hence has an insignificant effect upon the other wall portion. That is, it does not cause movement of the other wall portion so as to break its seal with the container. This advantage of this particular feature of the construction becomes clear when the filled and closed container is located beneath other identical filled and closed containers in a stack. As shown by FIG. 3, when a filled container 36 (chain-dotted outline) is located in position upon the closure portion 21 with its bottom adjacent the rim 23, it effects a downward movement and resilient twisting of the rim until the space 35 is closed and the lip 16 contacts the rim base 26. Although the upper wall portion 24*a* is thus twisted under such a load, it does not cause any buckling of wall portion 24*b*. In fact, the wall portion 24*b* moves very slightly further down the inner surface of the container wall portion 15 and in so doing, the sealing pressure at position 34 is increased, albeit by a very small amount, by virtue of the reduction in diameter of the wall portion 15 which tapers downwardly at an angle of 2°.

What is claimed is:

1. A plastic closure for a container comprising a closure portion and an annular rim surrounding the closure portion, the rim being of inverted U-shape and having radially spaced inner and outer axially extending walls which are joined by a base and defined a downwardly facing annular recess, the inner wall having a portion extending upwardly from the closure portion to the base and a resiliently flexible portion extending downwardly from the closure portion to terminate in a free end, the two portions having outer surfaces which increase in diameter as they extend from the closure portion, and the outer wall having a locking means facing into the recess to engage the annular wall of a container to hold the closure upon the container when the closure is fitted thereto.

2. A container and closure assembly wherein the container has an annular wall having a lip defining an opening and the closure is plastic and has a closure portion surrounding by an inverted U-shaped annular rim comprising radially spaced inner and outer axially extending walls which are joined by a base and define a downwardly facing annular recess within which the lip of the container is located, the inner wall having a portion extending upwardly from the closure portion to the base and a resiliently flexible portion extending downwardly from the closure portion to terminate in a free end, the two portions having outer surface which increase in diameter as they extend away from the closure portion and result in the upper portion and the free end of the lower portion sealingly engaging the lip and inner surface of the annular wall of the container in axially spaced-apart positions with the lower portion being resiliently flexed radially inwards by its engagement with the annular wall, the container and closure having mutually engaged locking means to hold the closure upon the container.

3. An assembly according to claim 2 wherein the annular wall of the container is tapered downwardly from the lip and in a normal position of the closure upon the container, the base of the closure is spaced from the lip of the container and the placing of a downward force upon the closure urges the U-shaped rim downwards to cause the base to move towards the lip and increase the sealing pressure of the upper portion of the inner wall upon the lip and increase the sealing pressure of the lower portion of the inner wall upon the tapered annular wall as its moves down the annular wall.

4. An assembly according in claim 2 wherein the sealing engagement in at least one of said spaced-apart positions is along a single annular line of contact which is substantially a point contact when considered in a cross-section along the axis of the assembly.

5. An assembly according to claim 2 wherein the outer wall of the closure is resiliently flexible outwardly to enable the closure to be fitted to the container and also removed therefrom by disengagement of the locking means.

6. An assembly according to claim 2 wherein the upper portion sealingly engages the lip at or adjacent the junction region of the inner wall with the base.

* * * * *